US012618605B2

(12) United States Patent
Lyons

(10) Patent No.: US 12,618,605 B2
(45) Date of Patent: May 5, 2026

(54) REFRIGERATION SYSTEM WITH DEMAND FLUID DEFROST

(71) Applicant: Hussmann Corporation, Bridgeton, MO (US)

(72) Inventor: Michael D. Lyons, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 50 days.

(21) Appl. No.: 18/472,324

(22) Filed: Sep. 22, 2023

(65) Prior Publication Data

US 2024/0102719 A1 Mar. 28, 2024

Related U.S. Application Data

(60) Provisional application No. 63/376,656, filed on Sep. 22, 2022.

(51) Int. Cl.
*F25D 21/00* (2006.01)

(52) U.S. Cl.
CPC ..... *F25D 21/002* (2013.01)

(58) Field of Classification Search
CPC ... F25D 21/002; F25D 21/025; F25B 2700/11
See application file for complete search history.

(56) References Cited

U.S. PATENT DOCUMENTS 3,377,817 A * 4/1968 Petranek ..... F25D 21/025 62/151
3,643,457 A * 2/1972 Winkler ..... F24F 5/001 62/151

(Continued)

FOREIGN PATENT DOCUMENTS

CN 106440604 A 2/2017
CN 107192206 A 9/2017

(Continued)

OTHER PUBLICATIONS

"Demand Defrost", Industrial Controls, <https://www.industrialcontrolsonline.com/training/online/demand-defrost>, Dec. 9, 2013 (6 pages).

(Continued)

*Primary Examiner* — Nelson J Nieves
(74) *Attorney, Agent, or Firm* — Michael Best & Friedrich LLP

(57) ABSTRACT

A refrigeration system including an evaporator defining an evaporator envelope and positionable to condition an airflow, the evaporator including an airflow inlet, an airflow outlet, and one or more refrigerant coils. The refrigeration system also includes a pressure sensor that is positioned to detect an outlet air pressure at or adjacent the outlet, and positioned to detect one or both of an ambient air pressure and an inlet air pressure and to generate a signal indicative of the corresponding air pressure. A control system in operative communication with the pressure sensor to determine a pressure differential based on the signal indicative of the outlet air pressure and the signal indicative of the ambient air pressure or the inlet air pressure, the control system configured to selectively initiate a demand defrost of the evaporator based on the determined pressure differential.

20 Claims, 6 Drawing Sheets

(56) References Cited

U.S. PATENT DOCUMENTS

| | | | | | |
|---|---|---|---|---|---|
| 3,653,223 | A * | 4/1972 | Jones | F25B 49/02 | 62/162 |
| 3,777,505 | A * | 12/1973 | Otaki | F25D 21/002 | 62/81 |
| 3,992,895 | A * | 11/1976 | Kramer | F25D 21/002 | 62/155 |
| 4,007,603 | A * | 2/1977 | Gustafsson | F25D 21/025 | 62/324.1 |
| 4,101,747 | A * | 7/1978 | Houk | F25D 21/025 | 200/81 R |
| 4,369,632 | A * | 1/1983 | Abraham | F25D 21/125 | 62/282 |
| 4,370,867 | A * | 2/1983 | Ibrahim | A47F 3/0447 | 62/282 |
| 4,409,795 | A | 10/1983 | Krueger | | |
| 4,538,420 | A * | 9/1985 | Nelson | F25D 21/002 | 62/155 |
| 4,646,529 | A * | 3/1987 | Hanson | F25D 21/008 | 62/155 |
| 4,694,657 | A * | 9/1987 | Vaughn | F25D 21/006 | 62/155 |
| 4,993,233 | A | 2/1991 | Borton et al. | | |
| 5,139,197 | A * | 8/1992 | Seshimo | G05D 7/0664 | 236/94 |
| 5,809,789 | A | 9/1998 | Baker et al. | | |
| 9,638,436 | B2 * | 5/2017 | Arensmeier | G05B 15/02 | |
| 11,035,605 | B2 | 6/2021 | Park et al. | | |
| 11,740,004 | B2 * | 8/2023 | Swab | F25D 11/003 | 62/80 |
| 2006/0242982 | A1 * | 11/2006 | Swofford | F25B 47/02 | 62/248 |
| 2007/0095519 | A1 * | 5/2007 | Hombucher | F24F 12/003 | 165/240 |
| 2017/0276422 | A1 * | 9/2017 | Chamoun | F25D 21/04 | |
| 2019/0072310 | A1 * | 3/2019 | Choi | F25D 21/006 | |
| 2019/0277554 | A1 * | 9/2019 | Park | F25D 21/00 | |
| 2020/0056833 | A1 * | 2/2020 | Park | F25D 21/004 | |
| 2020/0345157 | A1 * | 11/2020 | Navarro | A47F 3/0417 | |
| 2021/0071931 | A1 * | 3/2021 | Kim | F25D 21/025 | |
| 2022/0187007 | A1 * | 6/2022 | Swab | F25D 21/006 | |
| 2023/0106953 | A1 * | 4/2023 | Jovet | F25D 21/06 | 62/80 |
| 2024/0011697 | A1 * | 1/2024 | Park | F25D 21/08 | |

FOREIGN PATENT DOCUMENTS

| | | | |
|---|---|---|---|
| CN | 110822787 | A | 2/2020 |
| EP | 3086060 | A1 | 10/2016 |
| KR | 20040089620 | A | 10/2004 |
| KR | 20180009670 | A | 1/2018 |

OTHER PUBLICATIONS

Jay H. Jarrett, "A New Demand Defrost Control for Domestic Forced Draft Refrigerator", IEEE Transactions on Industry Applications, vol. IA-8, No. 3, pp. 356-364, May/Jun. 1972 (9 pages).

Kenneth S. Franklin, "Defrosting Methods", Service Application Manual, SAM Chapter 620-49, Section P1, publication date unknown (21 pages).

European Patent Office Search Report and Written Opinion for Application No. 23199161.3 dated Feb. 2, 2024 (11 pages).

* cited by examiner

REFRIGERATION SYSTEM WITH DEMAND FLUID DEFROST

This application claims priority to U.S. Provisional Patent Application No. 63/376,656, filed on Sep. 22, 2022, and entitled "Refrigeration System With Fluid Defrost", the content of which is hereby incorporated by reference in its entirety.

BACKGROUND

Background

The present invention relates to refrigeration systems and, more particularly, to fluid defrost of heat exchangers in refrigeration systems.

Refrigeration systems are well known and widely used in supermarkets, warehouses, and elsewhere to refrigerate product that is supported in a refrigerated space. Conventional refrigeration systems include a heat exchanger or evaporator, a compressor, and a condenser. The evaporator provides heat transfer between a refrigerant flowing within the evaporator and a fluid (e.g., water, air, etc.) passing over or through the evaporator. The evaporator transfers heat from the fluid to the refrigerant to cool the fluid. The refrigerant absorbs the heat from the fluid and evaporates in a refrigeration mode, during which the compressor mechanically compresses the evaporated refrigerant from the evaporator and feeds the superheated refrigerant to the condenser, which cools the refrigerant. From the condenser, the cooled refrigerant is typically fed through an expansion valve to reduce the temperature and pressure of the refrigerant, and then the refrigerant is directed through the evaporator.

Some evaporators operate at evaporating refrigerant temperatures that are near or lower than the freezing point of water (i.e., 32 degrees Fahrenheit). Over time, water vapor from the fluid freezes on the evaporator (e.g., on the coils) and generates frost. Accumulation of frost decreases the efficiency of heat transfer between the evaporator and the fluid passing over the evaporator, which causes the temperature of the refrigerated space to increase above a desired level. Maintaining the correct temperature of the refrigerated space is important to maintain the quality of the stored product. To do this, evaporators must be regularly defrosted to reestablish efficiency and proper operation. Many existing refrigeration systems use electric heaters that are placed underneath the evaporator to defrost the evaporator using convection heat. Other existing systems re-route hot gaseous refrigerant from the compressor directly to the evaporator so that heat from the hot refrigerant melts the frost on the evaporator (i.e. reverse hot gas defrost). Some evaporators draw air through a coil of the evaporator, which creates turbulent airflow through the coil. The turbulent airflow is further intensified with higher volumes of air, common in commercial refrigeration units. Many existing refrigeration systems include a sensor to measure a pressure differential within the coil. However, a pressure differential within the coil is generally higher than the pressure differential in the remainder of the refrigeration system due to the turbulent airflow within coil. In addition, the sensors are typically located within the volume or envelope of the coil, which reduces the capacity of the evaporator to condition the airflow because fins of the evaporator need to be adjusted or trimmed. Trimming the fins has a negative impact on coil performance.

SUMMARY

Frost and ice that forms on an evaporator of a commercial refrigeration system, such as a refrigerated merchandiser, acts as an insulating barrier that reduces heat transfer and can lead to reduced airflow across the coil. The rate of frost accumulation can vary significantly depending on variables such as ambient conditions, shopping volume, and/or case maintenance. Demand defrost, embodying the invention as described herein, initiates defrost cycles only when there is sufficient frost accumulation (as detected by appropriate mechanisms), which reduces overall energy usage and improves average product temperatures.

In one aspect, the present invention provides a refrigeration system having a refrigerant circuit including a condenser, an evaporator, a compressor, and a control system. The compressor is configured to circulate a cooling fluid through the refrigerant circuit. The refrigerant circuit has an inlet line fluidly connecting the condenser to the evaporator and a suction line fluidly connecting the evaporator to the compressor. The control system begins a defrost cycle for the refrigeration system based on a differential pressure of the evaporator.

Other aspects of the invention will become apparent by consideration of the detailed description and accompanying drawings.

DETAILED DESCRIPTION

Figure 1A:
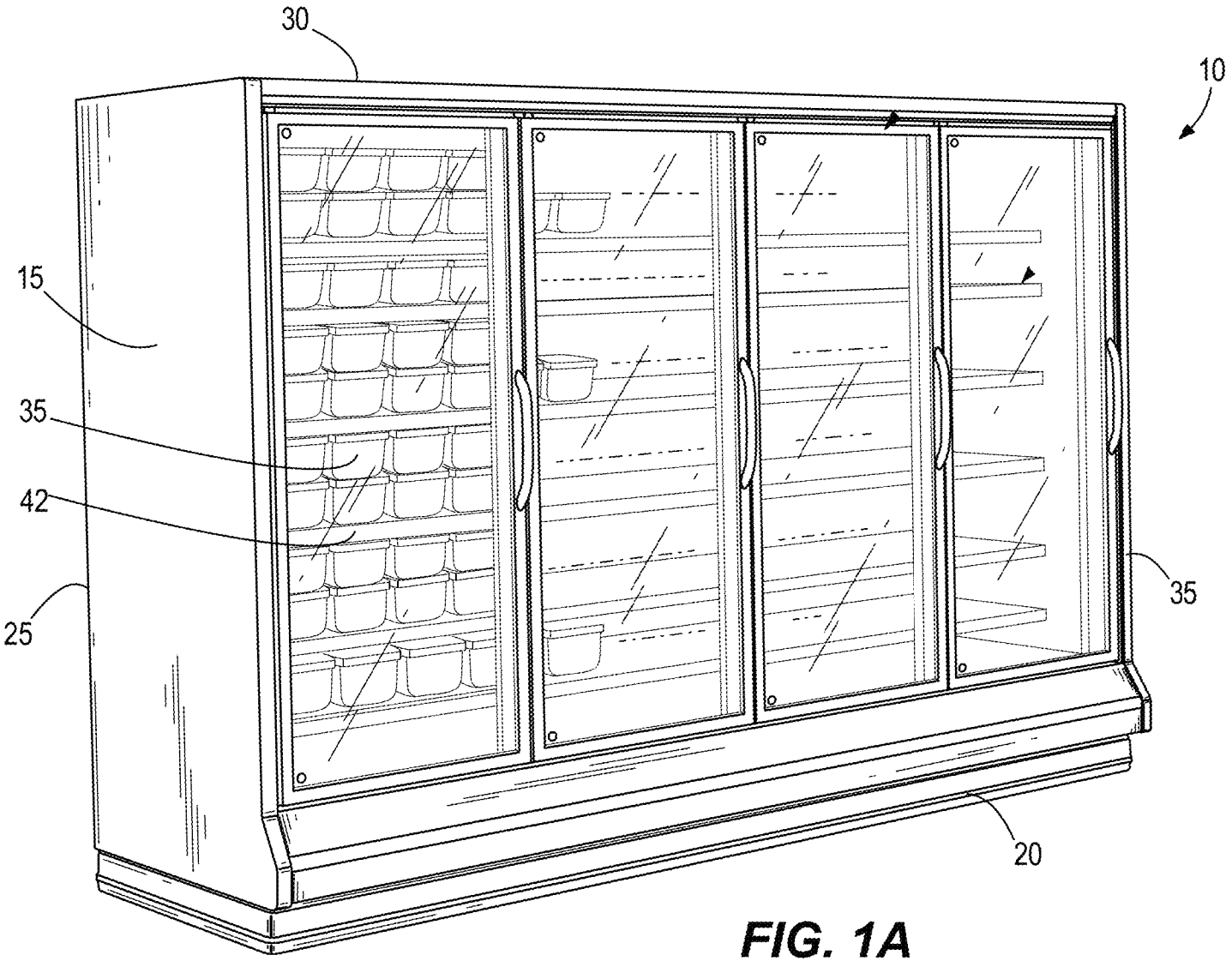
FIG. 1A is a cross-section of a refrigerated merchandiser including a product display area and an evaporator that is disposed in a refrigerant circuit of a refrigeration system embodying the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Features illustrated or described as part of one embodiment can be used with another embodiment to yield a still further embodiment. Thus, it is intended that the present invention covers such modifications and variations as come within the scope of the appended claims and their equivalents. The Detailed Description uses numerical and letter designations to refer to features in the drawings. Like or similar designations in the drawings and description have been used to refer to like or similar parts of the invention.

As used herein, the terms "first," "second," and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive- or and not to an exclusive- or. For example, a condition A or B is satisfied by any one of the following: A is true (or present) and B is false (or not present), A is false (or not present) and B is true (or present), and both A and B are true (or present).

Terms of approximation, such as "generally," "approximately," or "substantially," include values within ten percent greater or less than the stated value. When used in the context of an angle or direction, such terms include within ten degrees greater or less than the stated angle or direction. For example, "generally vertical" includes directions within ten degrees of vertical in any direction (e.g., clockwise or counterclockwise).

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

Figure 1B:
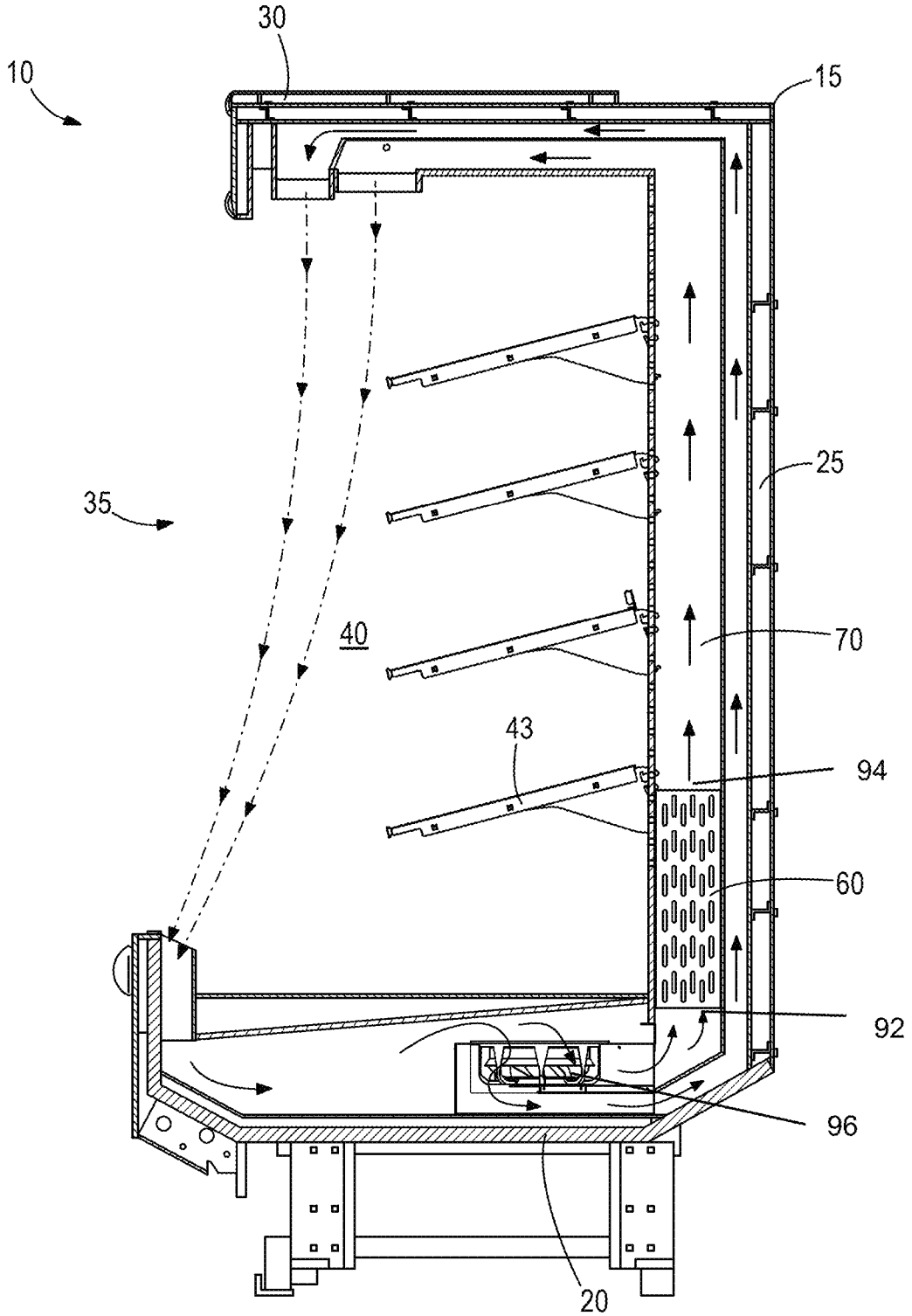
FIG. 1B is a cross-section of a refrigerated merchandiser including a product display area and an evaporator that is disposed in a refrigerant circuit of a refrigeration system embodying another embodiment of the present invention.

FIG. 1A illustrates an exemplary refrigerated merchandiser 10 that may be located in a supermarket or a convenience store (not shown) for presenting fresh food, beverages, and other product to consumers. The merchandiser 10 includes a case 15 that has a base 20, a rear wall 25, a canopy 30, and an opening 35 allowing access to the food product. The area partially enclosed by the base 20, the rear wall 25, and the canopy 30 defines a product display area 40 for supporting the food product in the case 15. For example, product can be displayed on racks or shelves 43 that extend forward from the rear wall 25, and the product may be accessible by consumers through the opening 35 adjacent the front of the case 15. As shown in FIG. 1A, the merchandiser 10 includes doors 42 coupled to the case 15 for enclosing the food product within the opening 35. As shown in FIG. 1B, the merchandiser 10 may be without the doors 42. For example, the merchandiser 10 may be an open front merchandiser. It should be appreciated that, while the invention herein is described in detail with regard to a refrigerated merchandiser, the invention is applicable to other structure including an evaporator that may require defrost from time to time.

Figure 2:
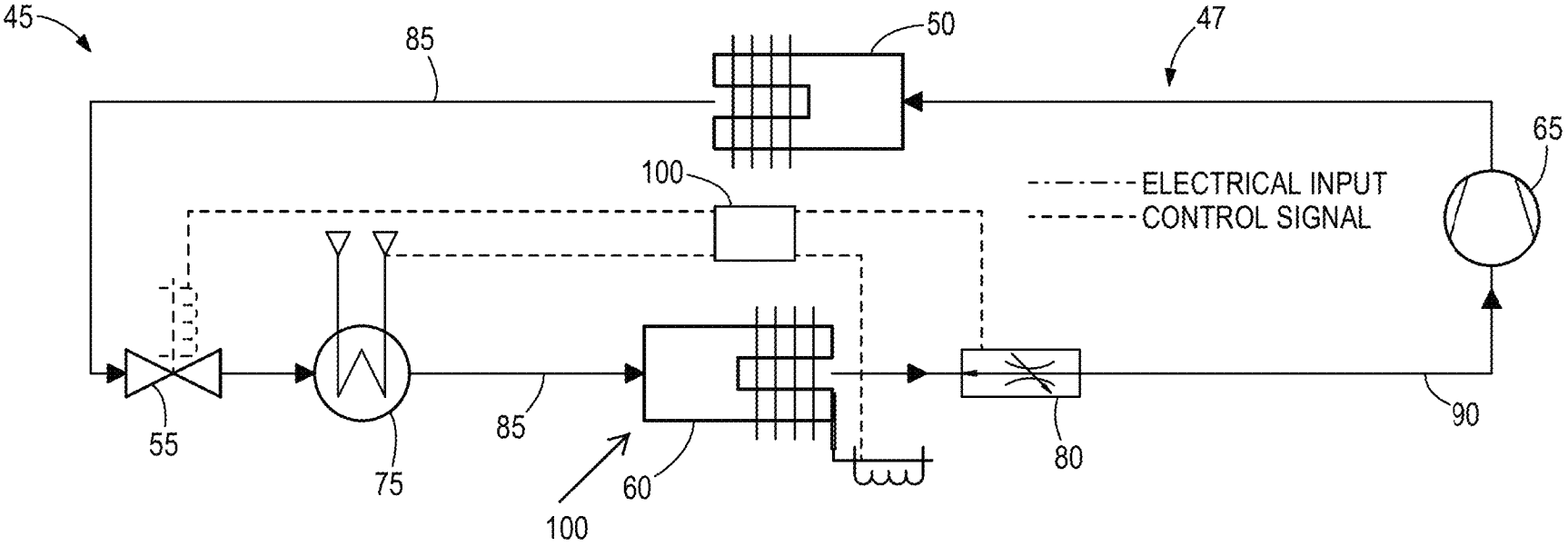
FIG. 2 is a schematic view of the refrigerated merchandiser of FIG. 1B when the refrigerated merchandiser is in a refrigeration mode.

As best shown in FIGS. 1B and 2, the refrigerated merchandiser 10 has at least a portion of an exemplary refrigeration system 45 that is in communication with the case 15 to provide a refrigerated airflow to the product display area 40. As shown in FIG. 2, the refrigeration system 45 includes a refrigerant circuit 47 that has a condenser 50, a flow control device 55, an evaporator 60, and a compressor 65 connected in series. The refrigerant circuit 47 has an inlet line 85 that fluidly connects the condenser 50 to the evaporator 60, and a suction line 90 that fluidly connects the evaporator 60 to the compressor 65. The flow control device 55 is disposed in the inlet line 85 and controls refrigerant flow to the evaporator 60 (and thus, the superheat at the evaporator outlet). The refrigerant circuit 47 also has a heater 75 (e.g., a ceramic heater, an induction heater, etc.) that is coupled to the inlet line 85 (illustrated downstream of the flow control device 55) upstream of the evaporator 60, and pressure control apparatus 80 that is disposed in the suction line 90. Referring back to FIG. 1B, the evaporator 60 is disposed in an air passageway 70 to condition air that is directed through the air passageway 70 as the air travels from an inlet 92 of the evaporator 60 to an outlet 94. The evaporator 60 defines an evaporator envelope that encompasses the coil(s) and any fins the evaporator 60 may have (i.e. the evaporator envelope is defined by the profile of the evaporator 60). As shown, a fan 96 is positioned upstream of the evaporator 60 to direct flow through the evaporator 60, although the fan 96 (or another fan) may be positioned downstream of the evaporator 60.

The refrigeration system 45 has a refrigeration mode during which the evaporator 60 conditions an airflow (e.g., the air flowing through passageway 70 in the merchandiser 10) based on heat transfer between the refrigerant in the evaporator 60 and air passing over the evaporator 60 (i.e. the refrigerant takes on heat from the air passing over the evaporator 60). The refrigeration system also has a defrost mode during which frost buildup on the evaporator 60 is reduced or removed. Although the invention is described with reference to its application in the refrigerated merchandiser 10, it will be appreciated that the refrigeration system 45 and defrost control described in detail below may have other applications.

Figure 3:
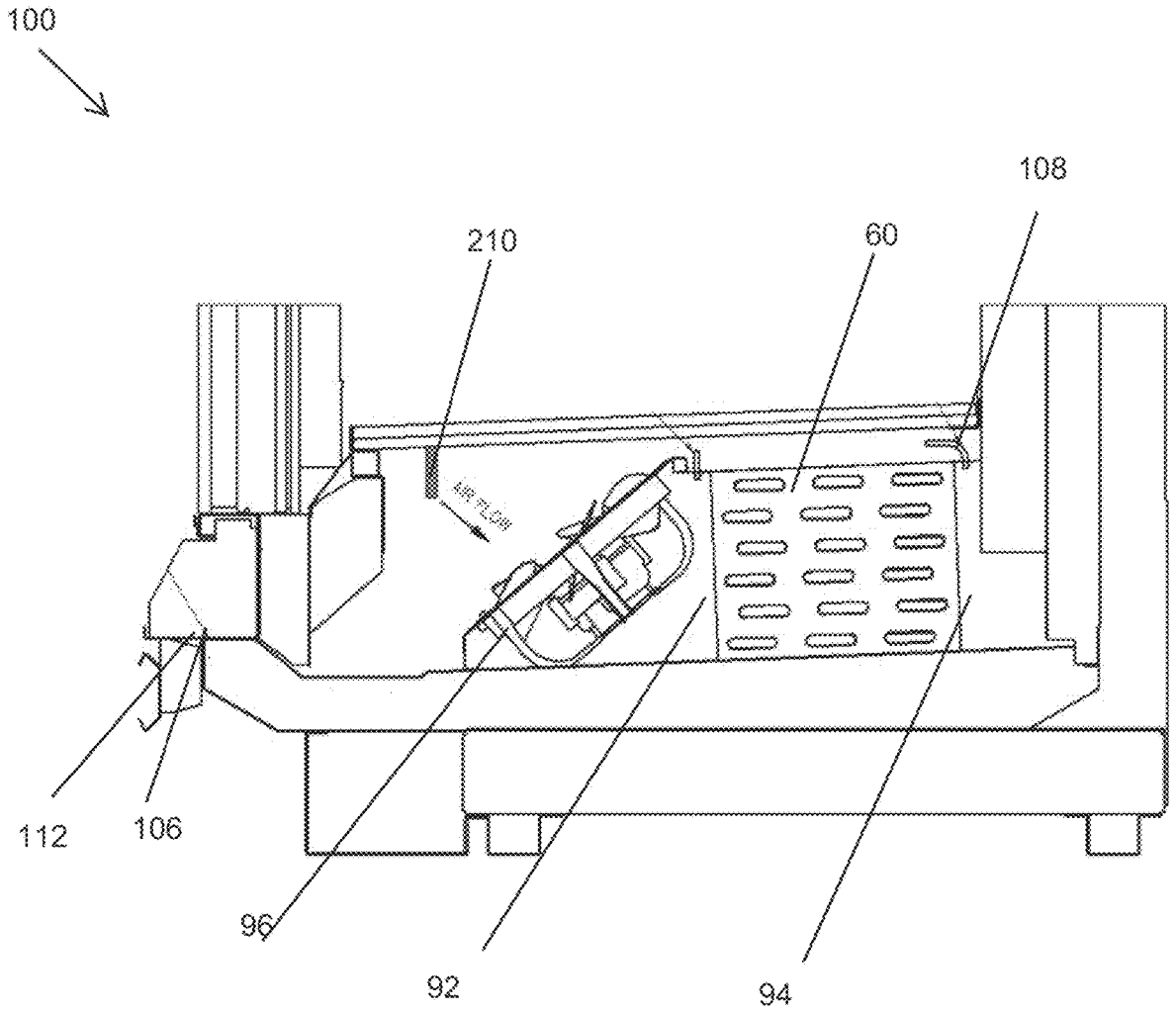
FIG. 3 is a cross-section of a refrigerated merchandiser depicting an evaporator according to another embodiment of the invention.

With reference to FIG. 3, the refrigeration system 45 includes a demand defrost system 100 that initiates a defrost cycle based on a differential air pressure measured by a control system 104 of the demand defrost system 100. As illustrated, the demand defrost system 100 includes a sensor 106 that has an outlet tap 108 disposed at or adjacent an outlet of the evaporator 60 (e.g., outside the coil or the evaporator envelope), and an ambient tap 112 that is disposed in communication with air outside the merchandiser 10 (i.e. ambient air). That is, the ambient tap 112 is not in communication with the airflow generated by the fan 96. The illustrated sensor 106 is in communication with the outlet tap 108 and the ambient tap 112 by vacuum tubing. Stated another way, the sensor 106 is operably fluidly coupled to at least two distinct locations (e.g., the outlet tap 108 and the ambient tap 112) in some manner (e.g., vacuum tubing or other communications such as wireless or wired) to sample air pressure at or adjacent the respective locations where sampling or sensing is desired. In some embodiments, the outlet tap 108 and the ambient tap 112 may be individual sensors that detect respective air pressures and communicate the sensed air pressures to a central location or another controller.

The outlet tap 108 is disposed or located at the outlet 94 of the evaporator 60 to detect air pressure at or adjacent the outlet 94. The ambient tap 112 is disposed on or located at or adjacent an external surface of the refrigeration system 45 or otherwise positioned (e.g., in or on an electrical raceway, exterior of the raceway, on the canopy 30, on an exterior side of the base 20, etc.) so that the sensor 106 may detect ambient air pressure (e.g., via vacuum tubing with an ambient port). The sensor 106 obtains pressure readings or data from the outlet tap 108 and the ambient tap 112 and provides the pressure data to the control system 104 so that the control system 104 can determine whether to initiate or stop defrost based on the pressure data alone or in combination with one or more other factors (e.g., whether a door of the merchandiser 10 is open, time of day, etc.). The location of the outlet tap 108 is chosen so that the outlet tap 108 is situated to detect the static pressure drop across the evaporator 60 (e.g., relative to ambient pressure or inlet air pressure). In some embodiments, pressure differential may be measured based on the evaporator inlet pressure and the evaporator outlet pressure. The ambient tap is open to atmosphere/outside the merchandiser in the electrical raceway, although it will be appreciated that the ambient tap 112 may be located elsewhere on the merchandiser 10 (e.g., the canopy 30, etc.).

The ambient tap 112 is located externally of components of the refrigeration system 45 and is open to atmosphere (e.g., external to the merchandiser 10, or external to the airflow envelope of the merchandiser 10) 45 to measure the pressure of ambient air adjacent the merchandiser 10. In one non-limiting example, the control system 104 measures a pressure differential between the ambient air pressure measured by the ambient tap 112 and the air pressure measured by the outlet tap 108. In the illustrated example, when the pressure differential between the ambient tap 112 and the outlet tap 108 drops below a pressure trigger value (e.g., for a predetermined timeframe), the control system 104 initiates a defrost cycle. In another example, the sensor 106 may sample from an inlet tap 210 rather than, or in addition to, the ambient tap 112. The inlet tap 210 may be coupled to the sensor 106 via vacuum tubing such that the sensor 106 provides pressure readings or data from the inlet tap 210 to the control system 104. In these embodiments, the control system 104 may determine the pressure differential based on the pressure readings at the outlet tap 108 and the inlet tap 210. It will be appreciated that the ambient pressure and the outlet pressure may be sensed by a sensor or sensors other than vacuum tube sensor(s).

The control system 104 includes a controller 120 that is electrically connected to the sensor 106. The controller 120 continuously or periodically measures the pressure differential between the ambient tap 112 and the outlet tap 108. In some embodiments, the defrost cycle is initiated when the pressure differential drops below the pressure trigger value for a minimum time. In some embodiments, the minimum time interval may reset whenever the pressure differential rises above the pressure trigger value or when the door is opened. Therefore, in some embodiments, the pressure differential must be below the pressure trigger value for the entirety of the minimum time interval before defrost is initiated (and in some circumstances, without the door being opened). In other embodiments, the pressure differential may be below the pressure trigger value for less than the entirety of the minimum time while still triggering defrost. In some embodiments, the controller 120 may control defrost without determining that a door is open or disregard when the door is opened such that a door opening event does not reset the minimum time. A door opening event may be detected directly via a sensor (e.g., operatively in communication with the door), or using controller logic to determine that a door is opened based on a sudden pressure change (e.g., the differential pressure equalizes to ambient pressure for a brief period while the door is opened) relative to the running average for the pressure differential over a period of time (e.g., 30 minutes).

The controller 120 selectively initiates a demand defrost cycle (e.g., outside of one or more timeframes when defrost is prevented, such as during times of high traffic or use; referred to herein as a "refrigeration window") when the current or detected differential pressure P drops below a pressure trigger value $P_{set}$ for more than a minimum time $T_{min}$. That is, the time $T_{count}$ that the pressure differential is below the pressure trigger value must reach or exceed the minimum time $T_{min}$ before the controller 120 initiates a demand defrost cycle. As described below, the controller 120 may account for additional information before initiating a demand defrost cycle. The minimum time $T_{min}$ may be reset whenever the differential pressure P is determined to be greater than the predetermined value $P_{set}$ or after a defrost cycle. In some embodiments including the merchandiser 10 with a door, the minimum time $T_{min}$ may reset when the door is opened. After defrost, the controller 120 waits a minimum defrost wait time interval $T_{int}$ before the controller 120 can initialize another demand defrost cycle. The minimum defrost wait time interval $T_{int}$ for an open-front merchandiser 10 may be 4 hours, or more or less than 4 hours. The minimum defrost wait time interval $T_{int}$ for a reach-in merchandiser 10 including doors 42 may be 24 hours, or more or less than 24 hours. It will be appreciated that the minimum defrost wait time interval $T_{int}$ for may vary depending on humidity or tropical conditions, especially in environments that do not have building air conditioning systems. In the latter situation, defrost likely will be more frequent.

The pressure trigger value $P_{set}$ is determined based on an initial pressure differential $P_{initial}$, which is determined during or shortly after initialization of a merchandiser 10 as described below. The pressure trigger value $P_{set}$ is a pressure differential value determined based on the pressure differential $P_{initial}$ and a multiplier (e.g., a percentage value) that is input into or stored in the controller 120 (e.g., $P_{set}=P_{initial}*i$, where 'i' is a set trigger percentage). The pressure trigger value $P_{set}$, when determined to be substantially below the initial pressure differential $P_{initial}$ is indicative of one or more adverse conditions associated with the merchandiser 10 and, in particular, the refrigeration system 45. In some embodiments, the pressure trigger value may be a percentage value of the initial pressure differential. In non-limiting examples, the set trigger percentage may be 35-40%, lower than 50%, or 50-60%. It will be appreciated that the set trigger percentage may be other values.

Figure 4:
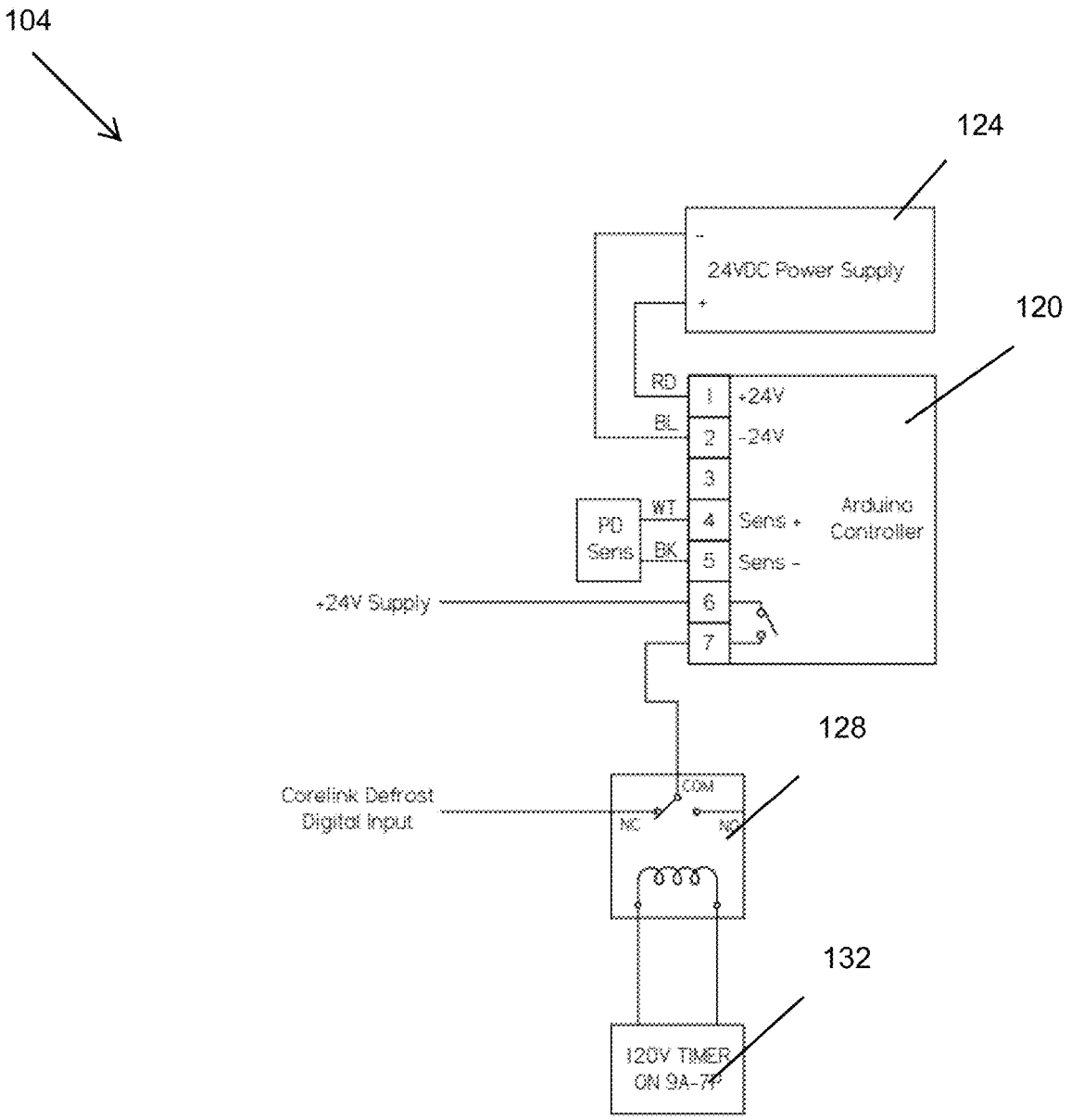
FIG. 4 is a schematic view of an exemplary control system for initiating a defrost cycle of the refrigerated merchandiser of FIG. 3.

With continued reference to FIG. 4, the illustrated control system 104 may also include a power supply 124 and a switch 128 that are operatively or communicatively coupled to the controller 120. For example, the power supply 124 is electrically connected to the controller 120 to power the controller 120. In some embodiments, the power supply 124 may be a 24 V DC battery. In other embodiments, the power supply 124 may be an AC battery, a voltage plug, or the like. The switch 128 is electrically coupled to the controller 120 such that the switch 128 receives a command from the controller 120 to execute. For example, the controller 120 sends a signal to the switch 128 to initiate the defrost cycle. After the switch 128 receives the signal, the switch 128 initiates the defrost cycle. A timer 132 is electrically coupled to the switch 128 and may block the switch 128 from receiving the signal that initiates the defrost cycle. In some embodiments, the timer 132 blocks the switch 128 from receiving the signal for a period of time (e.g., one hour, 4 hours, 24 hours, etc.) from the previous defrost cycle (referred to herein as time from previous defrost $T_{def}$). Additionally, the timer 132 may block the switch 128 from receiving the signal during certain or predetermined time periods (the "refrigeration window"). For example, as shown in FIG. 4, the timer 132 may block the switch 128 from 9 am to 7 pm due to higher use of the merchandiser 10 during that time period.

With reference to FIG. 2, when the refrigeration system 45 is in the refrigeration mode, the compressor 65 circulates a high-pressure cooling fluid or refrigerant (described as "refrigerant" for purposes of description) to the condenser 50. The condenser 50 rejects heat from the compressed refrigerant, causing the refrigerant to condense into high pressure liquid. The condensed refrigerant is directed through the inlet line 85 as a liquid to the flow control device 55, which expands the refrigerant into a low pressure (e.g., saturated) vapor refrigerant. The saturated refrigerant is evaporated as it passes through the evaporator 60 due to absorbing heat from air passing over the evaporator 60. The absorption of heat by the refrigerant permits the temperature of the airflow to decrease as it passes over the evaporator 60. The heated or gaseous refrigerant exits the evaporator 60 and is directed to the compressor 65 through the suction line 90 for re-processing through the refrigeration system 45. In the exemplary merchandiser 10, the cooled or refrigerated airflow exiting the evaporator 60 via heat exchange with the liquid refrigerant is directed through the remainder of the air passageway 70 and is introduced into the product display area 40 where the airflow will remove heat from and maintain the food product at desired conditions.

In the defrost mode or defrost cycle, components of the refrigeration system 45 are heated to remove or reduce frost that has built up during the refrigeration mode. In the defrost cycle, the heater 75 is activated, which begins heating the refrigerant flowing to the evaporator 60. The flow control device 55 regulates (e.g., maintains, increases, or decreases) the flow of refrigerant to the evaporator 60 during the defrost mode, and ensures that refrigerant continues to flow to the evaporator 60 in the defrost mode. The pressure control apparatus 80 is configured to increase system pressure during the defrost mode to maintain flow of refrigerant into the evaporator 60 and to control flow of refrigerant to the compressor 65. Refrigerant continues to flow to the compressor 65 during the defrost mode. In general, the pressure control apparatus 80 increases the amount of refrigerant mass in the evaporator 60 while controlling back-feeding of liquid refrigerant to the compressor 65. The constant flow of the heated refrigerant during the defrost mode increases the temperature of the evaporator 60 and melts frost on the exterior of the evaporator 60.

The controller 120 utilizes a control process embodied by instructions in a processor to determine whether to initiate a demand defrost cycle and to control operation of the refrigeration system 45 in the cooling or refrigeration mode and in the defrost mode, and to determine additional factors and criteria as described in detail below. In one example, and with reference to FIG. 5, on installation of a merchandiser 10 the controller 120 initializes the merchandiser 10 at step 300 (e.g., initialize variables, the refrigeration system 45, etc.). At step 305, the controller 120 determines the initial pressure differential $P_{initial}$ via data from the sensor 106 and establishes or receives one or more inputs regarding criteria for the pressure trigger value $P_{set}$ (e.g., defining the trigger percentage (i)). The initial pressure differential may be determined at or shortly after installation of the merchandiser 10 when there is no frost accumulation on or in the evaporator 60.

In general, and after determining the initial pressure differential $P_{initial}$, which may be an average pressure differential over a period of time (e.g., 5 minutes), the controller 120 continuously or periodically monitors or determines the pressure differential P between the outlet tap 108 and the ambient tap 112 via the sensor 106. The controller 120 averages the detected pressure differential P along with previous pressure differential values (referred to as "historical pressure differentials" or $P_{history}$) to identify an average pressure differential $P_{avg}$. For example, the controller 120 may average the pressure differential P and the immediately-previous nine (9) historical pressure differentials immediately preceding the detected pressure differential P (referred to herein as a "running average").

Figure 5:
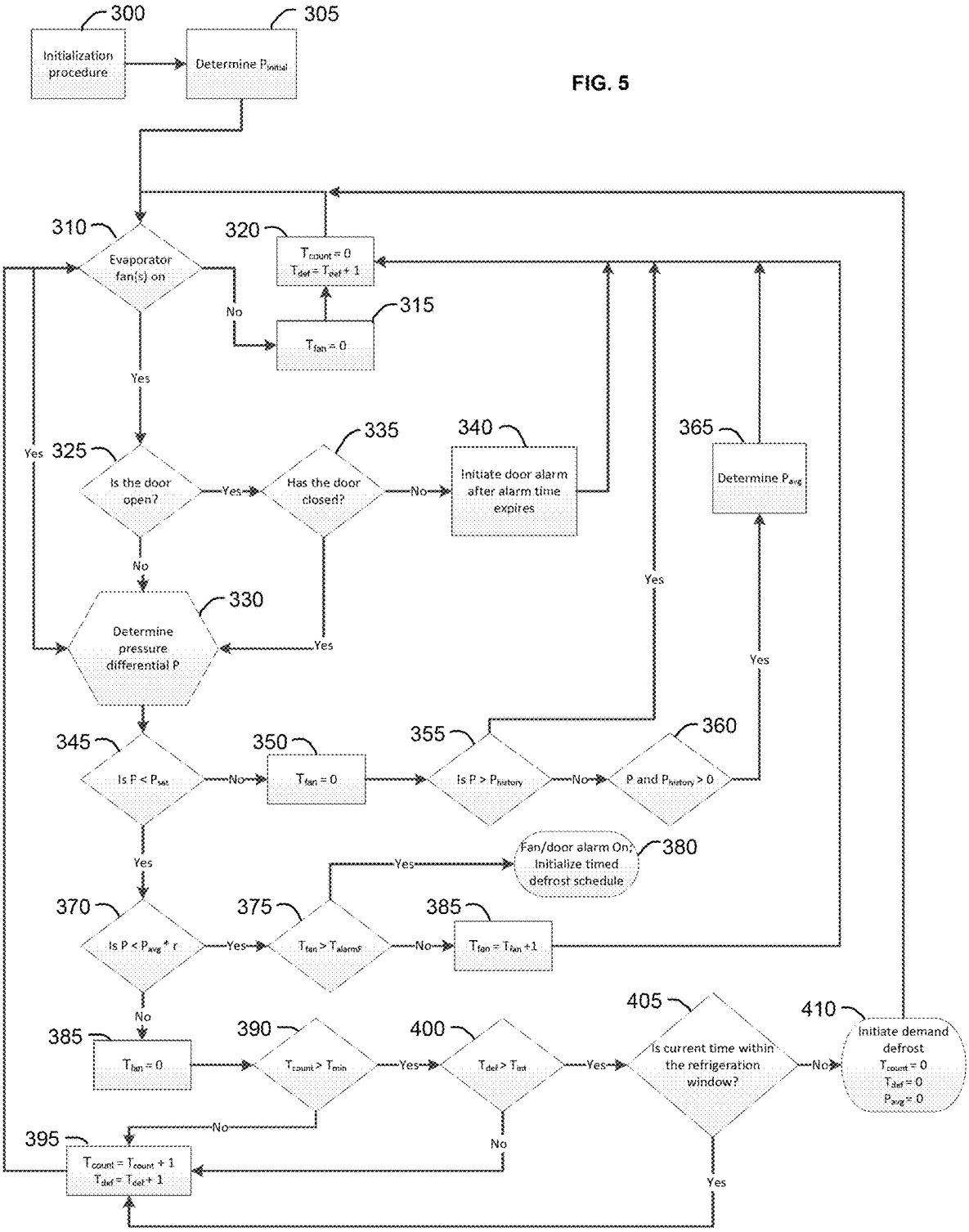
FIG. 5 is a flow chart illustrating an exemplary control system process for determining whether to initiate demand defrost.

With continued reference to FIG. 5, the controller 120 determines whether the refrigeration system 45 is in the cooling or refrigeration mode to condition the product display area 40. For example, the controller 120 determines whether the evaporator fan(s) 96 are On at step 310. If the fan(s) 96 are not On ("No" at step 310), the controller 120 sets the time of pressure drop Trail, which is the time that the detected pressure differential is below the threshold value, to zero (step 315). The control process then moves to step 320 and sets the length of time that the pressure differential P is below the pressure trigger value $T_{count}$ to zero and increments the time since last defrost cycle $T_{def}$. The controller 120 then restarts the control process at step 310.

If the fan(s) 96 are determined to be On ("Yes" at step 310), the controller 120 determines whether a door 42 is open (step 325) when the merchandiser 10 includes doors 42 (step 325), or the controller 120 determines the pressure differential P (step 330). In merchandisers 10 with doors 42, when the controller 120 determines that a door 42 is open ("Yes" at step 325), the controller 120 determines whether the door 42 has been closed at step 335. If the door 42 has not been closed ("No" at step 335), the control process initiates a door alarm at step 340 when the alarm time for a door open condition has been met or exceeded (expired). The process then sets the length of time that the pressure differential P is below the pressure trigger value $T_{count}$ to zero and increments the time since last defrost cycle $T_{def}$, and the process restarts at step 310.

If the door has been open less than the preset alarm time, the controller 120 continues to track or determine (at either or both of steps 335, 340) the amount of time the door has been open and the time since the previous defrost cycle. The controller 120 repeats steps 335, 340 until either the time the door has been open is greater than the preset alarm time or the door has been detected as closed. If the door is determined to be closed ("Yes" at step 335), the controller 120 determines the pressure differential P at step 330). It will be appreciated that steps 325-340 are omitted when the merchandiser 10 does not include doors.

Next, the control process determines whether the pressure differential P is less than the pressure trigger value $P_{set}$ at step 345. If not ("No" at step 345), the control process sets the time of pressure drop $T_{fan}$ to zero at step 350 and determines whether the pressure differential P is greater than the historical pressure differentials $P_{history}$ at step 355. If Yes at step 355, the process moves to step 320 and sets the length of time that the pressure differential P is below the pressure trigger value $T_{count}$ to zero and increments the time since last defrost cycle $T_{def}$. The process restarts at step 310.

When the pressure differential P is not greater than the historical pressure differentials $P_{history}$ ("No" at step 355), the process determines whether the pressure differential P and historical pressure differentials $P_{history}$ are greater than zero, respectively. If Yes, the process determines the average pressure differential $P_{avg}$ at step 365. The process then moves to step 320 and sets the length of time that the pressure differential P is below the pressure trigger value $T_{count}$ to zero and increments the time since last defrost cycle $T_{def}$. Thereafter process restarts at step 310.

When the controller 120 determines that the pressure differential P is less than the pressure trigger value $P_{set}$ at step 345, the controller 120 determines whether the pressure differential is less than the average pressure differential $P_{avg}$ multiplied by a value representative of the threshold "R" at which the average pressure differential is indicative of abnormal operation for the refrigeration system 45 (e.g., representative of as sudden loss of airflow indicating a fan failure). For example, the threshold R may be a value between approximately 0% and 60% (e.g., 25%, 40%, 50%, etc.). The threshold When the controller 120 determines that the pressure differential is lower than the average pressure differential $P_{avg}$ and the threshold R ("Yes" at step 370), the controller determines at step 375 whether time of the pressure drop $T_{fan}$ is greater than a threshold alarm timeframe $T_{alarmF}$. The alarm timeframe $T_{alarmF}$ may be any increment of time (e.g., 5 minutes, 3 minutes, 7 minutes, etc.) and is the threshold at which an alarm is triggered when the alarm timeframe $T_{alarmF}$ has been met or exceeded (step 380). The controller 120 initiates a timed defrost if the alarm timeframe $T_{alarmF}$ has been met or exceeded and personnel may be notified to shutdown the merchandiser 10. Thereafter process may restart at step 310.

If the pressure differential P is equal to or greater than the average pressure differential $P_{avg}$ multiplied by the threshold R ("No" at step 385), the controller 120 sets the pressure drop $T_{fan}$ to zero at step 350 and determines at step 390 whether the time $T_{count}$ is greater than the minimum time $T_{min}$ (the time determining whether to initiate demand defrost, e.g., 30 minutes). If not ("No" at step 390), the process moves to step 395 and increments the time $T_{count}$ and the time from previous defrost $T_{def}$. The process then returns to step 310.

If the controller 120 determines that the time $T_{count}$ is greater than the minimum time $T_{min}$ ("Yes" at step 390), the process determines whether the time since last defrost cycle $T_{def}$ is greater than the minimum defrost wait time interval $T_{int}$ at step 400. When the time since last defrost cycle $T_{def}$ is less than or equal to the minimum defrost wait time interval $T_{int}$ ("No" at step 400), the control process moves to step 395 and increments the time $T_{count}$ and the time from previous defrost $T_{def}$. The process then returns to step 310. When the time since last defrost cycle $T_{def}$ is greater than the minimum defrost wait time interval $T_{int}$ ("Yes" at step 400), the control process determines at step 405 whether the current time (e.g., time of day) is within the refrigeration window. If so ("Yes" at step 405), the control process moves to step 395 and increments the time $T_{count}$ and the time from previous defrost $T_{def}$. The process then returns to step 310. If the current time is not within the refrigeration window ("No" at step 405), the controller 120 initiates the demand defrost system and resets each of the pressure trigger value $T_{count}$, the time since last defrost cycle $T_{def}$, and the count for the average pressure differential (the running average) to zero and the process restarts after defrost is complete (e.g., the evaporator 60 is partially or fully defrosted based on input parameters input in the system). The defrost cycle may terminate based on a newly determined pressure differential P (e.g., via one or more processes in the control process described relative to FIG. 5).

Because frost accumulation on the evaporator 60 is incremental and not exponential, sudden changes in the detected pressure differential may be interpreted as a potential failure associated with the merchandiser 10 (e.g., a door remaining open, a fan failure, etc.). Also, when a door 42 is closed, especially forcefully, the sensed pressure differential may significantly increase (e.g., 50-60% higher than a normal or expected pressure differential from the sensor 106). Likewise, when a door 42 is opened, the suction created may significantly lower the pressure differential that is sensed by the sensor 106. In these situations, the pressure differential reading is ignored by the system.

The airflow induced by the fan 96 reduces as the static pressure drops across the evaporator 60 due to frost accumulation during refrigeration cycles. Demand defrost embodied in the invention described and claimed herein can be applied either as a standalone device to signal a storewide controller or implemented within a case-level controller for merchandisers or freezers with doors to reduce or eliminate frost accumulation. The controller monitors the air pressure outside the case relative to the air downstream of the evaporator coil. Additional inputs may optionally include door position, fan operation, and user specified time windows that are unacceptable for defrost cycles. The invention embodied herein and in the claims may be applied to drawn airflow or forced airflow configurations using one or more sensors to determine the pressure differential between ambient air and air downstream of the evaporator. In some embodiments, could potentially configure itself on various units without manual adjustment.

The system embodying the invention described and claimed herein is non-invasive to the evaporator and the airflow inside the merchandiser. The system does not require sensors in the heat transfer area of the evaporator and fins of the evaporator do not need to be adjusted or trimmed which would have a negative impact on coil performance. This method for demand defrost also does not require large data collection, therefore lower cost controllers can be utilized and less sensors are required in the case to monitor frost accumulation. This control model could also be adjusted to monitor open door conditions and evaporator fan failures. An advantage associated with the demand defrost system described herein is that the system determines the defrost trigger value based on the pressure differential reading ($P_{initial}$) on startup of the merchandiser read upon starting the case. This allows the demand defrost system to be applied to multiple cases and configurations without testing each application of the system to find the proper pressure trigger value.

Although the invention has been described in detail with reference to certain preferred embodiments, variations and modifications exist within the scope and spirit of one or more independent aspects of the invention as described. It will be appreciated that each feature of the merchandiser 10 and each feature of the control system may form the basis of one or more claims on its own or in any combination with any other feature or features. The order in which the control system is described (e.g., in FIG. 5) in no way informs the features, alone or in combination, that may be novel and inventive. The order that the control system has been described is only for convenience and should not be construed as limiting regarding what may be claimed.

Various features and advantages of the invention are set forth in the following claims.

The invention claimed is:

1. A refrigeration system comprising:

an evaporator defining an evaporator envelope and positionable to condition an airflow, the evaporator including an airflow inlet, an airflow outlet, and one or more refrigerant coils;

a pressure sensor positioned to detect an outlet air pressure at or adjacent the airflow outlet and to generate a signal indicative of the outlet air pressure, the pressure sensor further positioned to detect an ambient air pressure and to generate a signal indicative of the detected air pressure; and a control system including a controller in operative communication with the pressure sensor to determine a pressure differential based on the signal indicative of the outlet air pressure and the signal indicative of the ambient air pressure, the control system configured to selectively initiate a demand defrost of the evaporator based on a decrease in the determined pressure differential below a pressure trigger value.

2. The refrigeration system of claim 1, wherein the pressure sensor includes a single pressure sensor operatively coupled to the airflow outlet and to an exterior of the refrigeration system via a pressure tube.

3. The refrigeration system of claim 2, wherein the pressure sensor includes respective ports operatively coupled to the airflow outlet and to the exterior of the refrigeration system.

4. The refrigeration system of claim 1, wherein the control system is configured to stop the demand defrost based on another determined pressure differential after the demand defrost has been initiated.

5. The refrigeration system of claim 1, wherein the pressure sensor is configured to detect the ambient air pressure exterior of the refrigeration system.

6. The refrigeration system of claim 1, wherein the demand defrost is a fluid demand defrost.

7. The refrigeration system of claim 1, wherein the evaporator is disposed in a merchandiser including a case defining a product storage or display area and a fan positioned in the case to generate the airflow through the evaporator and the case, and wherein the pressure sensor is positioned external to an envelope of the airflow to detect the ambient air pressure.

8. The refrigeration system of claim 7, wherein the pressure sensor includes a single pressure sensor operatively coupled to the airflow outlet and to the case at a location exterior of the refrigeration system including the fan and the evaporator.

9. The refrigeration system of claim 8, wherein the pressure sensor includes a first vacuum tube connected to the location exterior of the refrigeration system to sense the ambient air pressure and a second vacuum tube connected to the case at or downstream of the airflow outlet.

10. The refrigeration system of claim 7, wherein the case includes an electrical raceway and the pressure sensor is positioned in or exterior of the electrical raceway.

11. The refrigeration system of claim 7, wherein the pressure sensor is a first pressure sensor, the merchandiser further comprising a second pressure sensor positioned to detect a pressure of the airflow at or adjacent the airflow inlet.

12. The refrigeration system of claim 7, wherein the control system is configured to stop the demand defrost based on another determined pressure differential after the demand defrost has been initiated.

13. A method of controlling a demand defrost in a refrigeration system including an evaporator and a fan configured to generate an airflow through the refrigeration system, the method comprising:

sensing a first air pressure in the refrigeration system via a first sensor at a first location at or downstream of an outlet of the evaporator, the evaporator defining an evaporator envelope;

generating a first signal indicative of the first air pressure;

sensing a second air pressure exterior to the refrigeration system via a second sensor at a second location outside the evaporator envelope, the second location further outside an envelope of the airflow;

generating a second signal indicative of the second air pressure;

determining a pressure differential based on the first signal and the second signal via a control system operatively communicating with the first sensor and the second sensor; and selectively initiating the demand defrost of the evaporator via the control system in response to the determined pressure differential decreasing below a pressure trigger value.

14. The method of claim 13, further comprising establishing the pressure trigger value during startup or initialization of the refrigeration system.

15. The method of claim 13, further comprising determining an alarm condition based on the determined pressure differential.

16. The method of claim 13, wherein the first sensor and the second sensor comprise one sensor, the method further comprising sensing the first air pressure via a first vacuum tube operatively coupled to the first location and sensing the second air pressure via a second vacuum tube operatively coupled to the second location.

17. The method of claim 13, further comprising determining whether a time threshold has been exceeded prior to initiating the demand defrost.

18. The method of claim 17, wherein the time threshold includes one or more of a refrigeration window, a time from previous defrost, and a length of time that the determined pressure differential is below the pressure trigger value.

19. The method of claim 13, further comprising iteratively determining additional pressure differentials and determining an average pressure differential based on the iterative determinations.

20. The method of claim 19, further comprising determining an alarm condition associated with the refrigeration system based on the average pressure differential.

* * * * *